US005098108A

United States Patent [19]

McKinney

[11] Patent Number: 5,098,108

[45] Date of Patent: Mar. 24, 1992

[54] CLOTHES HAMPER

[75] Inventor: Charles T. McKinney, Dallas, Tex.

[73] Assignee: Charlico, Inc., Dallas, Tex.

[21] Appl. No.: 190,412

[22] Filed: May 5, 1988

Related U.S. Application Data

[63] Continuation-in-part of Ser. No. 9,085, Aug. 24, 1987, abandoned.

[51] Int. Cl.[5] ..... A63B 63/08; A45C 11/00

[52] U.S. Cl. ..... 273/400; 211/86; 211/99; 232/1 B; 232/43.1; 273/1.5 R

[58] Field of Search ..... 273/1.5 R, 1.5 A, 400; 211/86–89, 99, 113; 248/227; 232/1 B, 43.1

[56] References Cited

U.S. PATENT DOCUMENTS

| | | | |
|---|---|---|---|
| 97,061 | 11/1869 | Dixon et al. | 232/43.1 |
| 978,429 | 12/1910 | Barnett | 232/43.1 |
| 1,459,599 | 6/1923 | Minor | 232/43.1 |
| 2,053,635 | 9/1936 | Sandeberg | 273/1.5 R |
| 2,085,206 | 6/1937 | Holmdahl | 273/1.5 R |
| 2,907,516 | 10/1959 | Follett et al. | 232/43.1 |
| 3,603,588 | 9/1971 | Ebstein | 273/1.5 R |
| 3,814,359 | 6/1974 | Powell | 273/1.5 A X |
| 3,850,367 | 11/1974 | Fortriede | 232/1 B |
| 3,888,486 | 6/1975 | Sutter et al. | 273/400 |
| 4,468,027 | 8/1984 | Pangburn | 273/1.5 R |

FOREIGN PATENT DOCUMENTS

| | | | |
|---|---|---|---|
| 627208 | 1/1963 | Belgium | 273/1.5 R |
| 46159 | 12/1935 | France | 211/99 |
| 278232 | 10/1951 | Switzerland | 211/86 |
| 282060 | 4/1952 | Switzerland | 211/99 |

*Primary Examiner*—Paul E. Shapiro

*Attorney, Agent, or Firm*—Michael A. O'Neil

[57] ABSTRACT

A clothes hamper (10) includes a backboard (12) configured and decorated to resemble a basketball backboard. Brackets (18) support the backboard at the top of a door. First and second generally S-shaped hooks, each having a first U-shaped configuration at one end of the S for fitting over the top edge of a door, the portion over the door edge being flattened sufficiently to enable the door to be closed with the hook over the top thereof and a second U-shaped configuration at the other end of the S in inverted relationship to the first U-shaped end for extending through the apertures of the spaced frame brackets so as to support the backboard in a vertical orientation on the door. A hoop (26) configured to resemble a basketball goal is supported on the backboard by a unitary mounting plate for pivotally attaching the hoop to the lower half of the frame. The mounting plate comprises a flat upper portion located above the U-shaped mounting projection and attached to the frame; an arcuate center portion integrally formed with the flat upper portion and having a mating fit over the closed end of the U-shaped mounting projection; and a horizontally projecting shoulder on each side of the arcuate center portion for supporting the legs of the U-shaped mounting projection to hold the hoop in a horizontal position perpendicular to the backboard but allowing the hoop to freely pivot only in the upward direction against the frame for storage purposes. The hoop, and in turn supports a mesh clothes receiving net (38) that extends vertically downwardly therefrom. The lower end of the mesh net is normally closed by a drawstring (42).

3 Claims, 3 Drawing Sheets

CLOTHES HAMPER

CROSS REFERENCE TO RELATED APPLICATIONS

This application is a continuation-in-part application of application Ser. No. 07/09,085, filed Aug. 24, 1987, abandoned.

TECHNICAL FIELD

This invention relates generally to clothes hampers, and more particularly to a clothes hamper that is especially designed for use by children.

BACKGROUND AND SUMMARY OF THE INVENTION

One of the most persistent and aggravating tasks of parenting involves teaching children the habit of depositing their dirty clothing in a clothes hamper. The present invention overcomes this longstanding problem by providing a clothes hamper which is both convenient and fun to use.

In accordance with the invention, a backboard is configured and decorated to resemble a basketball backboard. Brackets are provided for securing the backboard to a convenient door, for example, the entryway door for a child's room, a closet door, a bathroom door, etc.

A hoop configured to resemble a basketball goal is mounted on the backboard and defines a clothes receiving aperture positioned in an offset relationship with respect to the backboard. A clothes receiving net in the form of an elongated tube is secured at one end to the hoop and is maintained in an open, clothes receiving configuration. The opposite end of the clothes receiving net is normally maintained in a closed condition by a drawstring.

DESCRIPTION OF THE DRAWINGS

A more complete understanding of the invention may be had by reference to the following Detailed Description when taken in conjunction with the accompanying Drawings.

DETAILED DESCRIPTION

Figure 1:
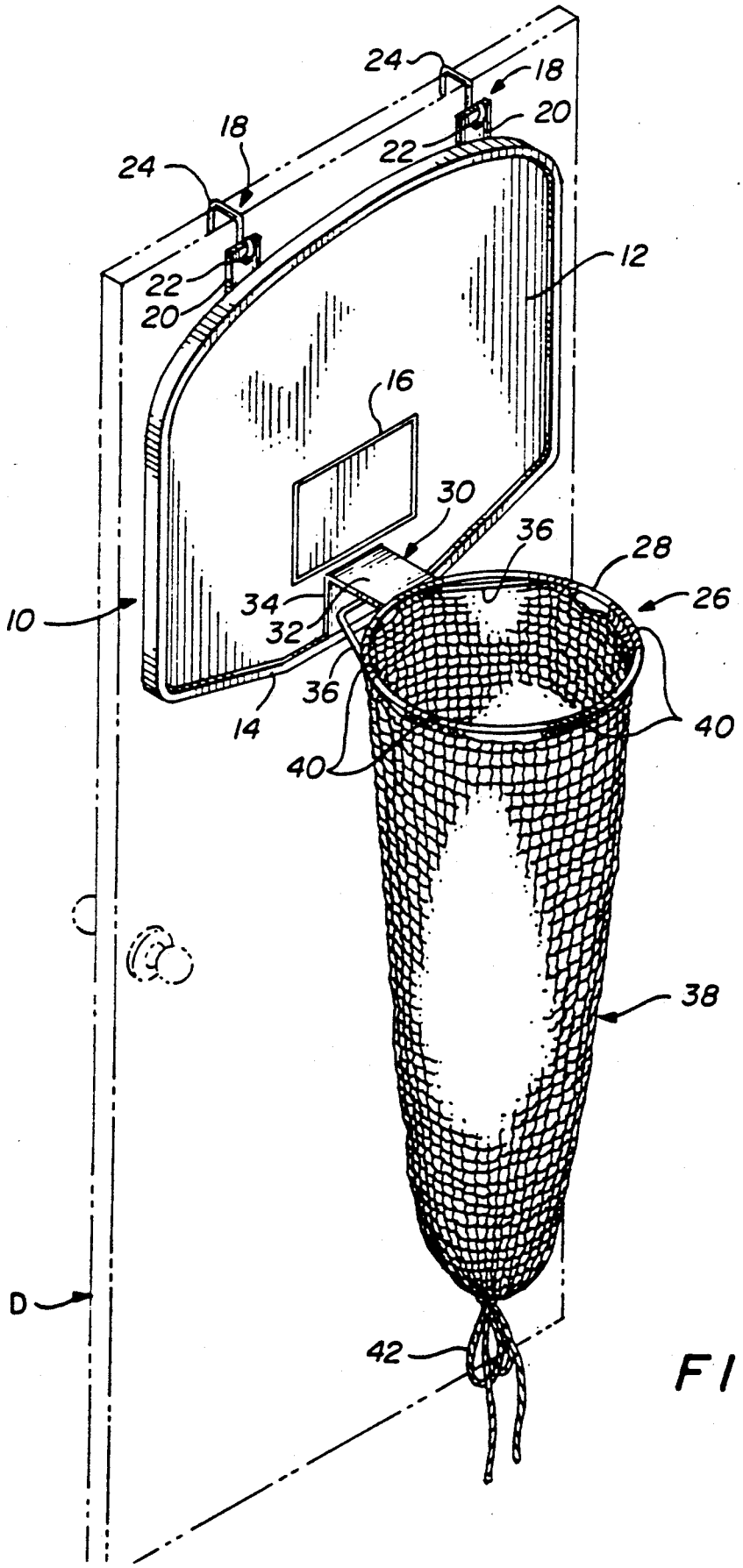
FIG. 1 is a perspective view of a clothes hamper incorporating the invention.

Referring now to the Drawings, and particularly to FIG. 1 thereof, there is shown a clothes hamper 10 incorporating the preferred embodiment of the invention. The clothes hamper 10 includes a backboard 12 that is configured and decorated to resemble a basketball backboard. The backboard 12 may be formed from glass, various plastics, and/or various metals. However, the backboard 12 is preferably fabricated from an inexpensive material such as particle board, and is finished by painting.

In accordance with the preferred embodiment of the invention, the backboard 12 is painted white or off-white, and may be decorated with accent stripes 14 and 16 that are preferably red or bright orange. Other color schemes may be utilized in the fabrication of the backboard 12, if desired.

Brackets 18 are provided for securing the backboard 12 of the clothes hamper 10 at the top of a suitable door D. The door D may comprise any door that is suitably located to position the clothes hamper 10 for convenient use by a child. For example, the door D may comprise the entryway door to a child's room, a closet door, a bathroom door, etc.

Each bracket 18 comprises a bracket plate 20 that is secured to the backboard 12 by suitable means, such as threaded fasteners. An aperture 22 extends through the upper end of each bracket plate 20. A hook 24 extends through each aperture 22 and in turn receives the door D. It will be understood that other types of brackets may be utilized in the practice of the invention to secure the backboard 12 to a convenient door D, if desired.

The clothes hamper 10 further comprises a hoop 26 configured to resembled a basketball goal. The hoop 26 is preferably formed entirely from a convenient metal, for example, steel or aluminum. However, various plastic materials may be utilized in the fabrication of the hoop 26, if desired. The hoop 26 is preferably painted or otherwise colored to contrast with the color of the backboard 12 and is attached to the lower half of the backboard 12 to cause the backboard 12 and hoop 26 to resemble an actual basketball hoop and backboard.

The hoop 26 includes an annular member 28 in defining a clothes receiving aperture. The annular member 28 extends perpendicularly to the backboard 12, and is supported in an offset relationship with respect thereto by an L-shaped bracket 30. The L-shaped bracket 30 includes a horizontal leg 32 that is secured to the annular member 28 by suitable means, for example, welding or brazing. The L-shaped bracket 30 further includes a vertical portion 34 that is secured to the backboard 12 by suitable means, such as threaded fasteners. A bail 36 extends between the vertical portion 34 of the L-shaped bracket 30 and the annular member 28 to stabilize the positioning of the annular member 28 relative to the backboard 12, and are secured in place by suitable means, such as welding or brazing.

An elongated clothes receiving net 38 is secured at one end to the annular member 28 of the hoop 26 and extends downwardly therefrom. The net 38 may be formed from any convenient material such as a loose, pliable mesh of nylon or cotton, and is configured to resemble the mesh net of a basketball goal, except that it is many times longer.

The net 38 is substantially equal in diameter to the annular member 28 of the hoop 26, and is secured at one end to the annular member 28 by suitable means. For example, the net 38 may be secured to the annular member 28 by short lengths of string or cord which are tied in place. Alternatively, metal or plastic clips 40 may be utilized to secure the upper end of the net 38 to the annular member 28. The clips 40 may be formed integrally with the annular member 28, if desired.

The opposite or lower end of the net 38 is normally secured in a closed condition by means of a drawstring 42. Other conventional closures for the lower end of the net 38 may be utilized in the practice of the invention, if desired.

Figure 2:
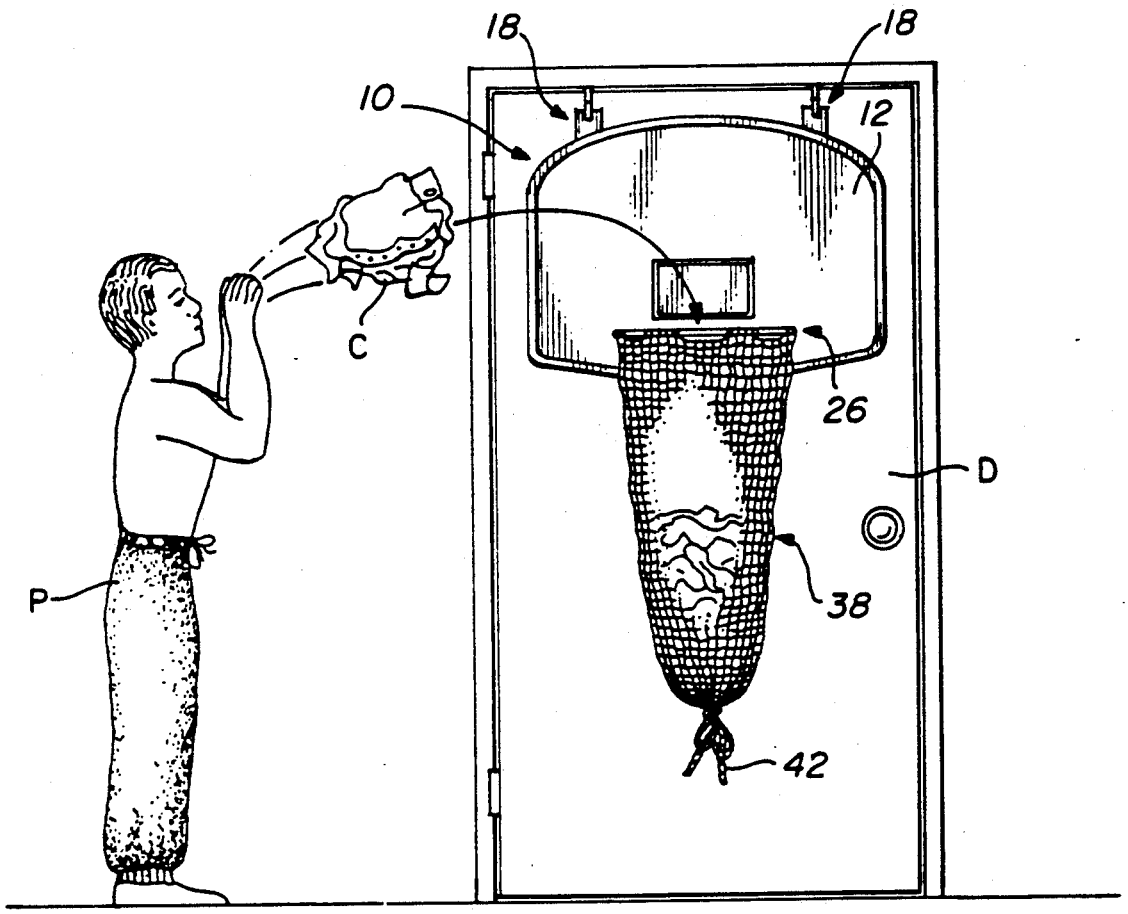
FIG. 2 is a diagrammatic illustration of the use of the clothes hamper of FIG. 1.
Figure 3:
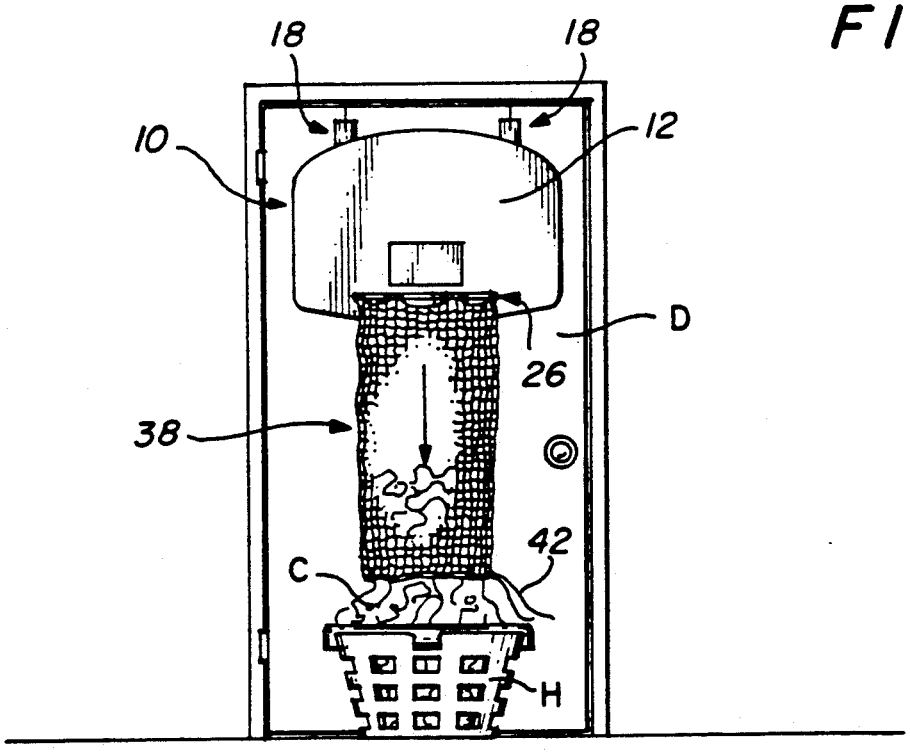
FIG. 3 is a further illustration of the use of the clothes hamper.

The use of the clothes hamper 10 of the present invention will be better understood by reference to FIGS. 2 and 3. The brackets 18 are utilized to secure the backboard 12 at the top of a convenient door D. The backboard 12 is thus oriented vertically on the door D, and the hoop 26 extends horizontally outwardly from the backboard 12 and from the door D. The net 38 extends vertically downwardly from the hoop 26. The upper end of the net 38 is secured to the hoop 26 and is maintained thereby in an open, clothes receiving configuration. The lower end of the net 38 is normally maintained in a closed, clothes retaining configuration by the drawstring 42.

Soiled clothes C are deposited in the clothes receiving net 38 of the clothes hamper 10 by a person P, normally a child. This is accomplished by throwing, tossing, hooking, dunking, etc., the clothes C through the hoop 26 into the clothes receiving net 38 in the manner of a conventional basketball shot. The clothes C may be deposited into the clothes receiving net 38 directly through the hoop 26, or they may be banked off the backboard 12 through the hoop 26 and into the net 38, if desired.

After the net 38 is full of soiled clothes C, or at periodic intervals, the drawstring 42 is disengaged from the lower end of the net 38, so that the lower end of the net 38 is open. The clothes C then fall downwardly under the action of gravity into a clothes hamper H. The clothes hamper H is utilized to transport the clothes C to a convenient laundry facility, and the drawstring 42 is again employed to close the lower end of the net 38.

Figure 4:
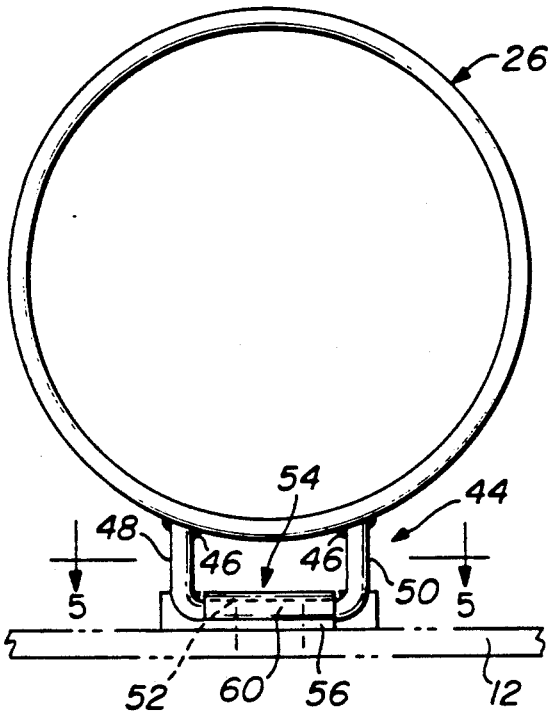
FIG. 4 is a top view of an alternate embodiment in which the hoop is supported in its horizontal position but can be folded upwardly against the backboard for storage purposes.

A second embodiment of the hoop and backboard is shown in a top view in FIG. 4. The hoop 26 has a U-shaped mounting projection generally designated by the numeral 44 of circular cross section extending horizontally from and rigidly attached to the hoop 26 at 46 by such well known means as, for example, welding. The U-shaped mounting projection 44 has first and second legs 48 and 50 joined by a bottom portion 52. The U-shaped mounting projection 44 lies in the same plane as the hoop 26. A unitary mounting plate 54 is utilized to pivotally attach hoop 26 to the lower half of the backboard 12 in the same location as the embodiment shown in FIG. 1.

Figure 5:
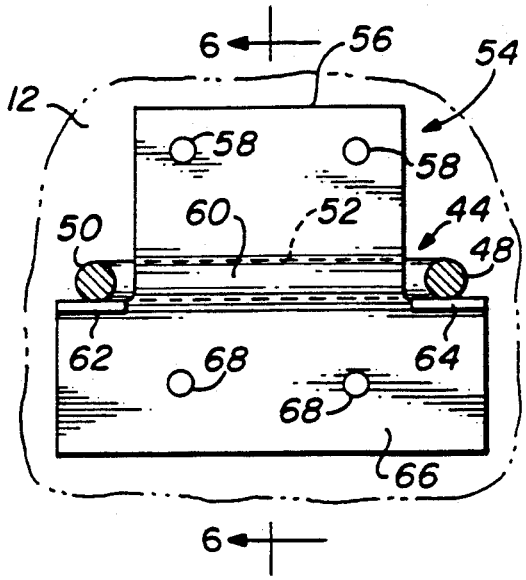
FIG. 5 is plan view of the unitary mounting plate for pivotally attaching the hoop to the lower half of the frame as shown in FIG. 4.

FIG. 5 is a partial cross sectional view taken along line 5—5 of FIG. 4 and provides a plan view of the unitary mounting plate 54. As can be seen in FIG. 5, the unitary mounting plate 54 comprises a flat upper portion 56 located above the U-shaped mounting projection 44 and attached to the backboard 12 by means of screws or bolts through holes 58.

Figure 6:
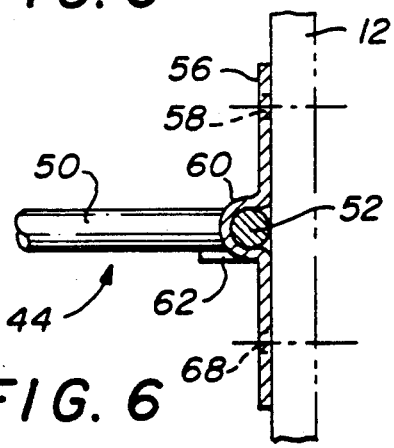
FIG. 6 is a side view of the unitary mounting plate illustrating the arcuate center portion of the unitary mounting plate which provides a mating fit over the bottom of the hoop U-shaped mounting projection.

The mounting plate 54 also has an arcuate center portion 60 for a mating fit over the bottom portion 52 of the U-shaped mounting projection 44 as can be best seen in the side view in FIG. 6 taken along lines 6—6 of FIG. 5. Horizontally projecting shoulders 62 and 64 extend on each side of the arcuate center portion 60 to support the legs 48 and 50 of the U-shaped mounting projection 44. Thus, the shoulders 62 and 64 hold the hoop 26 in a horizontal position perpendicular to the backboard 12, but allow the hoop 26 to pivot upwards against the backboard 12 for storage purposes. It can be seen from FIGS. 5 and 6 that there are no obstructions to the pivoting of the hoop 26 in a clockwise direction in FIG. 6 about the bottom portion 52 of the U-shaped mounting projection 44. However, it can also be seen that the hoop 26 and attached U-shaped mounting projection 44 cannot pivot counterclockwise from the position shown in FIG. 6 because of the horizontally projecting shoulders 62 and 64.

The mounting Plate 54 also has a lower portion 66 extending downwardly from the arcuate center portion 60. This lower portion 66 is attached to the backboard 12 by means of screws or bolts through holes 68.

Figure 7:
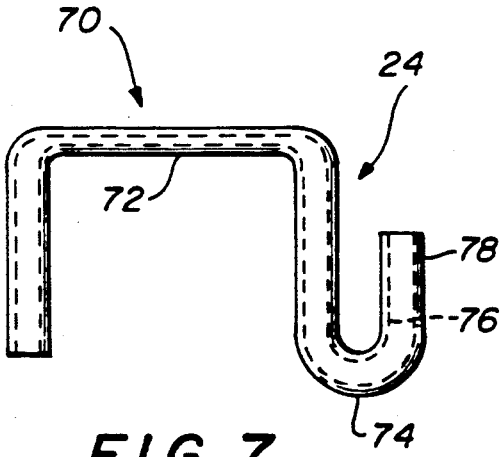
FIG. 7 is side view of a S-shaped hook having a first U-shaped configuration at one end of the S for fitting over the top of a door and a second U-shaped configuration at the other end of the S for extending through the aperture of one of the bracket plates to support the backboard on the door.
Figure 8:
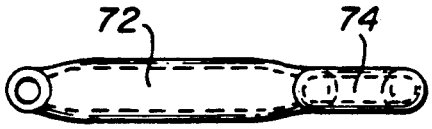
FIG. 8 is a bottom view of the hook in FIG. 7.
Figure 9:
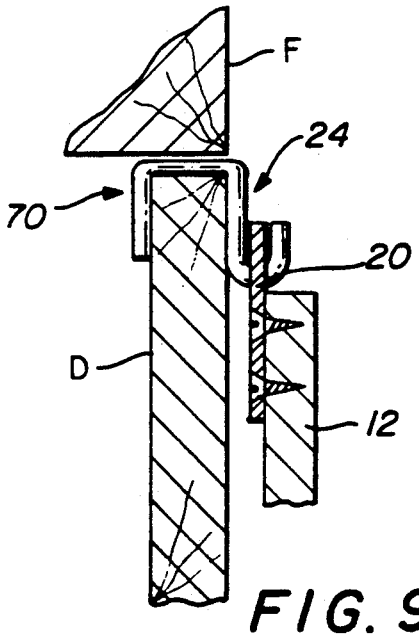
FIG. 9 is a partial cross sectional view of the S-shaped hook over the door while the door is closed and holding the backboard in position by means of the second U-shaped configuration on the hook which extends through the aperture of the bracket plate.

The hooks 24 may be generally S-shaped as shown in side view in FIG. 7 in detail. Each S-shaped hook 24 has a first U-shaped configuration 70 at one end of the S for fitting over the top edge of a door in an inverted position. That is, the U is inverted as shown in FIG. 9.

A second U-shaped configuration 74 is at the other end of the S-shaped hook 24. These configurations 74 extend through the apertures 22 of the spaced bracket plates 20 on the backboard 12 to support the backboard 12 on the door.

Each S-shaped hook 24 is formed of a cylindrical metal rod 76. The portion 72 of the hook 24 that fits over the top edge of the door D is flattened to fit between the door D and the door frame F.

The entire hook 24 is coated with a material such as soft plastic. This prevents the hook 24 from damaging any furniture or other surface that it contacts.

Although preferred embodiments of the invention have been illustrated in the accompanying Drawings and described in the foregoing Detailed Description, it will be understood that the invention is not limited to the embodiments disclosed, but is capable of numerous rearrangements, modifications, and substitutions of parts and elements without departing from the spirit of the invention.

I claim:

1. A clothes hamper for being supported from the top of door comprising:

a frame configured and decorated to resemble a basketball backboard;

a pair of flat, elongated, vertically extending bracket plates rigidly mounted to and extending above the top edge of the back of said frame in spaced relationship, each of said bracket plates having an aperture therein located above the top edge of the frame;

first and second generally S-shaped hooks, each having a first U-shaped configuration at one end of the S for fitting over the top edge of a door, said portion over said door edge being flattened sufficiently to enable said door to be closed with the hook over the top thereof and a second U-shaped configuration at the other end of the S in inverted relationship to the first U-shaped end for extending through the apertures of the spaced frame brackets so as to support the backboard in a vertical orientation on said door;

a hoop defining a circular clothes receiving aperture;

a U-shaped mounting projection of circular cross section extending horizontally from and rigidly attached to the hoop at the open end of the U;

a unitary mounting plate for pivotally attaching the hoop to the lower half of the frame, the mounting plate comprising:

a flat upper portion located above the U-shaped mounting projection and attached to the frame;

an arcuate center portion integrally formed with the flat upper portion and having a mating fit over the closed end of the U-shaped mounting projection;

a horizontally projecting shoulder on each side of the arcuate center portion for supporting the legs of the U-shaped mounting projection and thereby holding said hoop in a horizontal position perpendicular to the backboard but allowing the hoop to freely pivot only in the upward direction against the frame for storage purposes; and a flat lower portion integrally formed with and extending downwardly from the arcuate center portion for attachment to the frame;

an elongated clothes receiving mesh net resembling a basketball hoop net supported on and extending vertically downwardly from the hoop;

means for securing the upper end of the clothes receiving net to the clothes receiving aperture of the hoop so that the upper end of the net is maintained in an open, clothes receiving configuration; and means for normally releaseably securing the lower end of the clothes receiving mesh net in a closed, clothes retaining configuration.

2. The clothes hamper according to claim 1 wherein the means for normally securing the lower end of the clothes receiving net in a closed, clothes retaining configuration comprises a drawstring;

3. The clothes hamper according to claim 1 wherein the hoop is configured to resemble a basketball goal.

* * * * *